US010454183B1

(12) United States Patent
Wolf et al.

(10) Patent No.: US 10,454,183 B1
(45) Date of Patent: Oct. 22, 2019

(54) MULTI-TILE AESA SYSTEMS AND METHODS

(71) Applicant: Rockwell Collins, Inc., Cedar Rapids, IA (US)

(72) Inventors: Jeremiah D. Wolf, Atkins, IA (US); Roger A. Dana, Marion, IA (US); Matilda G. Livadaru, Marion, IA (US)

(73) Assignee: ROCKWELL COLLINS, INC., Cedar Rapids, IA (US)

( * ) Notice: Subject to any disclaimer, the term of this patent is extended or adjusted under 35 U.S.C. 154(b) by 404 days.

(21) Appl. No.: 15/217,865

(22) Filed: Jul. 22, 2016

(51) Int. Cl.

| | |
|---|---|
| ***H01Q 21/00*** | (2006.01) |
| ***H01Q 3/34*** | (2006.01) |
| ***H01Q 1/36*** | (2006.01) |
| ***H01Q 1/38*** | (2006.01) |

(52) U.S. Cl.
CPC ..... *H01Q 21/0025* (2013.01); *H01Q 1/36* (2013.01); *H01Q 1/38* (2013.01); *H01Q 3/34* (2013.01)

(58) Field of Classification Search
CPC .. H01Q 1/36; H01Q 1/38; H01Q 3/34; H01Q 3/385; H01Q 21/0025
USPC ..... 342/371
See application file for complete search history.

(56) References Cited

U.S. PATENT DOCUMENTS

| | | | | |
|---|---|---|---|---|
| 6,366,259 | B1 * | 4/2002 | Pruett | H01Q 21/0025 343/853 |
| 9,391,375 | B1 * | 7/2016 | Bales | H01Q 21/24 |
| 2010/0171674 | A1 * | 7/2010 | Henderson | H01Q 13/08 343/778 |

* cited by examiner

*Primary Examiner* — Dao L Phan
(74) *Attorney, Agent, or Firm* — Donna P. Suchy; Daniel M. Barbieri

(57) ABSTRACT

An active electronically scanned array (AESA) antenna system can include a plurality of printed circuit boards (PCBs) having a common shape. Each PCB of the plurality of PCBs can include a respective sub-array of antenna elements surrounded by a passive area, and can include electronic circuitry for electrically steering the sub-array of antenna elements. The AESA antenna system can include a mechanical seal for mechanically connecting the PCBs hosting the sub-arrays to form an antenna array of the sub-arrays. The passive areas can form separation areas between adjacent ones of the sub-arrays when the PCBs are mechanically connected to each other. The sub-arrays are arranged such that the separation areas are contiguous along at most one straight direction across the antenna array.

16 Claims, 10 Drawing Sheets

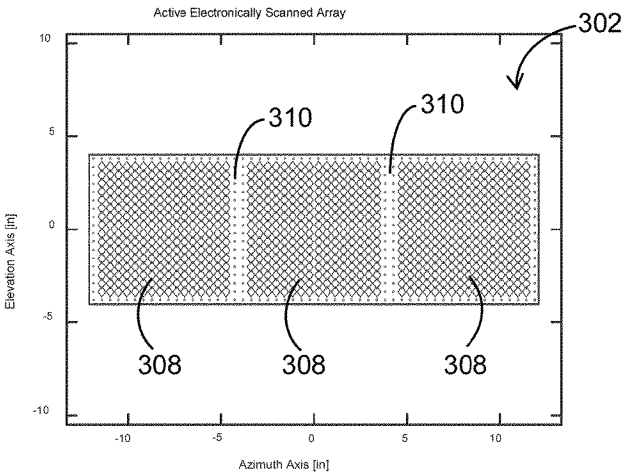
FIG. 3A
FIG. 3B
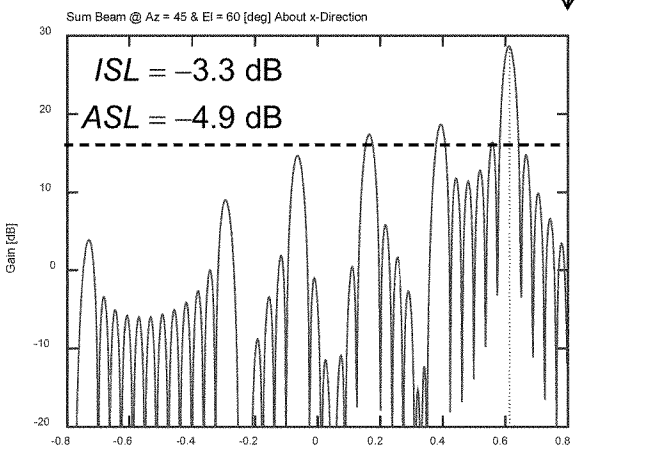
FIG. 3C
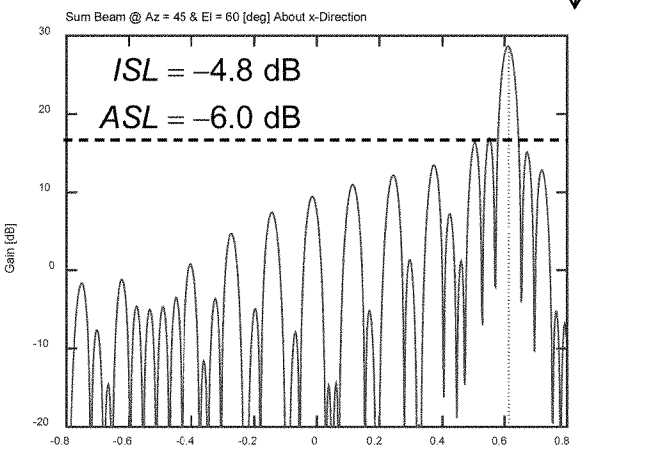
FIG. 3D

MULTI-TILE AESA SYSTEMS AND METHODS

BACKGROUND

Active electronically scanned array (AESA) systems provide reliable performance over respective ultra-wide bands (UWBs) of operating frequencies. AESA systems are commonly used in communication systems, military and weather radar systems, electronic intelligence systems, or biological or medical microwave imaging systems. An AESA system makes use of an array of radiating elements (or antenna elements) steerable via a respective group of transmit/receive modules (TRMs). By independently steering each of its antenna elements, an AESA system provides a relatively high reception/transmission performance through constructive accumulation of signals associated with a plurality of antenna elements. Also, because of the inherent capability to simultaneously use, and independently steer, a respective plurality of antenna elements, the single failure of one or few antenna elements within an AESA system have little effect on the operation of the AESA system as the rest of the antenna elements can continue to function un-interrupted. Furthermore, AESA systems are difficult to jam because of their capability to hop from one operational frequency to another within the respective UWB.

The signal received/transmitted by an AESA antenna system is a combination of the signals received/transmitted by the respective antenna elements. As such, the power of the received/transmitted signal can increase with the number of antenna elements in the AESA system. Various applications call for larger electronically scanned array (ESA) systems, active or passive, to improve signal gain, reception sensitivity, and smaller beam width. As such, printed circuit boards (PCB) of ESA systems are becoming excessively large. However, manufacturing of large PCBs suffers from poor yield, therefore, driving up cost significantly. In particular, manufacturing large PCBs involves a relatively larger number of sequential laminations, which increases the likelihood of manufacturing deficiencies and leads to the poor yield.

Due to the poor yield associated with the fabrication of large PCBs, the demand for larger number of antenna elements in ESA systems may not be practically fulfilled using monolithic PCBs. Another alternative to construct large ESA systems is by tiling multiple smaller PCBs, each corresponding to a respective ESA sub-system, into a large ESA system. Multi-tile ESA systems are beneficial from a yield and cost standpoint. However, tiling PCBs presents various technical challenges with regard to the mechanical coupling of the PCBs without perturbing the electronic components of the respective ESA subsystems, with regard to the protection of the ESA sub-systems, or with regard to the performance of the resulting ESA system.

One common performance factor for antenna arrays is the distribution and strength of respective radiation pattern sidelobes. In particular, the sidelobes that are closest to the main lobe of an antenna array can contribute the most to signal interference. When designing antenna arrays, one of the goals is to reduce the number and the gain of the sidelobes.

SUMMARY

In one aspect, the inventive concepts disclosed herein are directed to an active electronically scanned array (AESA) antenna system that includes a plurality of printed circuit boards (PCBs) having a common shape. Each PCB of the plurality of PCBs can include a respective sub-array of antenna elements surrounded by a passive area and has electronic circuitry for electrically steering the sub-array of antenna elements. The AESA antenna system can include a mechanical seal for mechanically connecting the PCBs including the sub-arrays to form an antenna array of the sub-arrays. The passive areas can form separation areas between adjacent ones of the sub-arrays when the PCBs are mechanically connected to each other. The sub-arrays are arranged such that the separation areas are contiguous along at most one straight direction across the antenna array.

In some embodiments, the separation areas can be non-contiguous along any straight direction across the antenna array. The common shape can comprise a plus shape. The common shape can comprise a rectangle. The common shape can comprise a square. The common shape can comprise a hexagon. The common shape can comprise a diamond shape. The common shape can comprise a parallelogram.

In some embodiments, the separation areas can include one or more inactive or disabled antenna elements. The separation areas can be free of antenna elements. The mechanical seal can include a mechanical chassis arranged around a periphery of the antenna array. The mechanical seal can include one or more mechanical connectors arranged at the separation areas for mechanically connecting adjacent PCBs.

In a further aspect, the inventive concepts disclosed herein are directed to an AESA antenna aperture that includes a plurality of sub-array regions having a common shape. Each of the plurality of sub-array regions includes a plurality of antenna elements. The AESA antenna aperture may include a plurality of passive areas residing between adjacent ones of the plurality of sub-array regions. The plurality of passive areas are contiguous along at most one straight direction across the AESA antenna aperture.

The separation areas can be non-contiguous along any straight direction across the antenna array. The common shape can include at least one of a plus shape, a rectangle, a square, a hexagon, a diamond, and a parallelogram. The passive areas can include inactive or disabled antenna elements. In some embodiments, the passive areas can be free of antenna elements.

In a further aspect, the inventive concepts disclosed herein are directed to a method of providing an AESA antenna system. The method comprises manufacturing a plurality of (PCBs having a common shape. Each PCB of the plurality of PCBs includes a respective sub-array of antenna elements surrounded by a passive area. Each PCB of the plurality of PCBs has electronic circuitry for electrically steering the sub-array of antenna elements. The method also comprises mechanically connecting the plurality of PCBs hosting the sub-arrays to form an antenna array of the sub-arrays. The passive areas form separation areas between adjacent ones of the sub-arrays. The separation areas are contiguous along at most one straight direction across the antenna array.

The common shape can includes at least one of a plus shape, a rectangle, a square, a hexagon, a diamond shape, or a parallelogram. The passive areas can include inactive or disabled antenna elements. In some embodiments, the passive areas can be free of antenna elements. The separation areas can be non-contiguous along any straight direction across the antenna array.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings:

FIGS. 3A-3B show diagrams illustrating two example embodiments of multi-tile AESA aperture configurations;

FIGS. 3C and 3D show plots illustrating simulations of antenna beams for embodiments of AESA apertures shown in FIGS. 3A and 3B, respectively;

Figure 1:
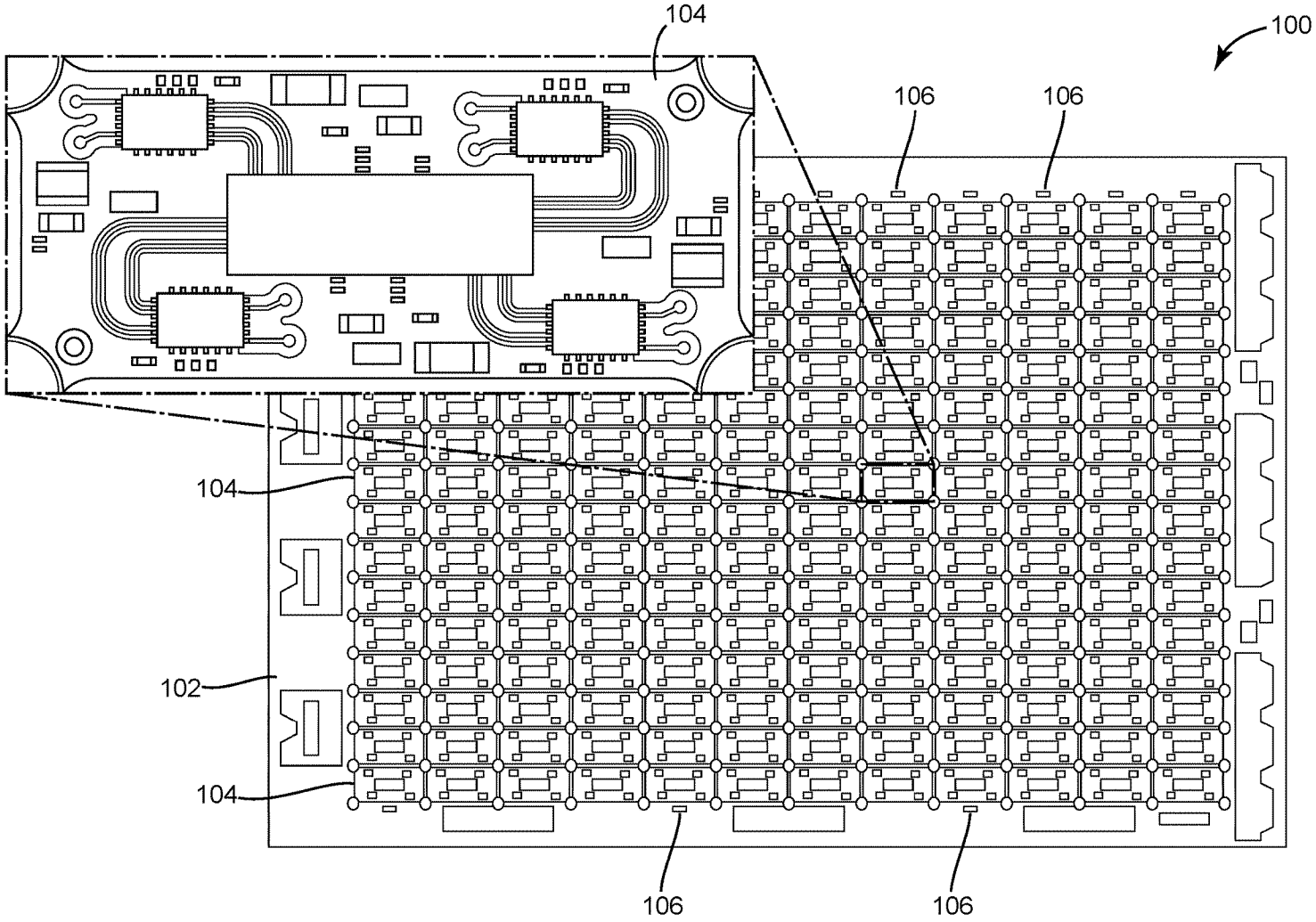
FIG. 1 shows a diagram illustrating an example embodiment of PCB tiling.

The details of various embodiments of the methods and systems are set forth in the accompanying drawings and the description below.

DETAILED DESCRIPTION

Before describing in detail embodiments of the inventive concepts disclosed herein, it should be observed that the inventive concepts disclosed herein include, but are not limited to a novel structural combination of components and circuits, and not to the particular detailed configurations thereof. Accordingly, the structure, methods, functions, control and arrangement of components and circuits have, for the most part, been illustrated in the drawings by readily understandable block representations and schematic diagrams, in order not to obscure the disclosure with structural details which will be readily apparent to those skilled in the art, having the benefit of the description herein. Further, the inventive concepts disclosed herein are not limited to the particular embodiments depicted in the diagrams provided in this disclosure, but should be construed in accordance with the language in the claims.

Referring now to the drawings, FIG. 1 shows a diagram illustrating an example PCB tiling 100. The PCB tiling 100 includes a mechanical chassis 102 arranged around the periphery of an array of PCBs 104. Each PCB 104 can include a respective sub-array of antenna elements (not shown in FIG. 1), such as an active or passive electronically scanned array (ESA). The mechanical chassis 102 can provide a mechanical attachment mechanism to mechanically couple or incorporate the PCBs 104 into a multi-PCB ESA system. The mechanical chassis 102 can allow for protection against environmental factors such as storms, wind, rain, snow, temperature, or the like, for example, by preventing bending or deformation. The mechanical chassis 102 can also allow for mounting additional protection mechanisms or structures to protect the ESA system or the respective antenna elements from dust, humidity or other contaminants.

The mechanical chassis 102 includes o-rings 106 for mechanically coupling the PCBs 104 to the mechanical chassis 102. For instance, an o-ring 106 can overlap with an area of a PCB 104 that is beyond where electric or electronic components of the PCB 104 are located. Any mechanical coupling mechanism to tile the PCBs 104 together should not interfere with the electronics of the PCBs 104. PCB areas behind the antenna elements are usually crowded with electrical or electronic components and may not be suitable for integrating or hosting mechanical coupling means (such as screws, glue or the like). The PCBs 104 can include passive areas (e.g., free of electric or electronic components) used for mechanically coupling or sealing the PCBs 104 to each other into a large multi-PCB ESA system. The passive areas may be usually located at the boundaries of the PCBs 104. The PCBs 104 can be arranged according to horizontal rows and vertical columns as shown in FIG. 1. As such, the passive areas form continuous elongated areas, free from active antenna elements, along the width and the length of the antenna array formed by the PCB tiling 100.

The relative locations of the sub-arrays with respect to one another, the number of antenna elements in the PCB tiling 100 as well as the size, shape, and number of the passive areas between the sub-arrays, can affect the performance of the multi-PCB ESA system. In particular, the width, the continuity and/or the frequency of the passive areas can influence the distribution and/or amplitudes of the sidelobes associated with the multi-PCB ESA system. For instance, the wider the passive areas and the far apart the sub-arrays from each other, the higher is the level of the sidelobes.

Figure 2A:
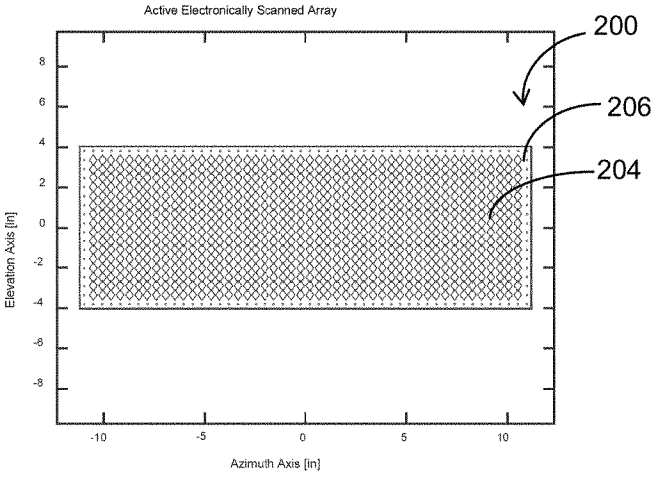
FIGS. 2A and 2B show diagrams illustrating two example configurations of embodiments of relatively large active electronically scanned array (AESA) apertures.
Figure 2B:
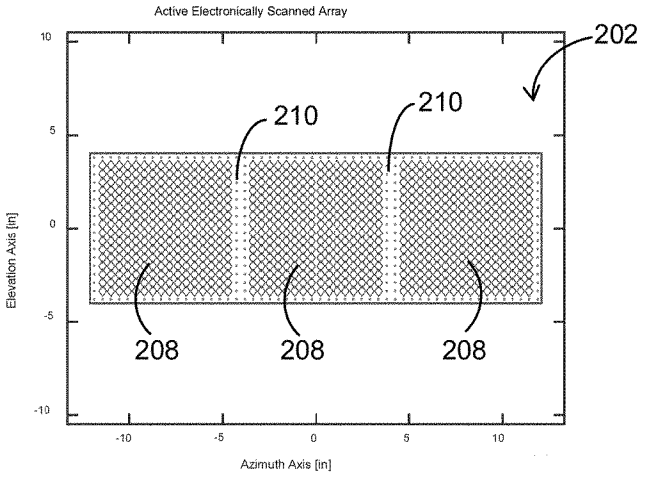

Referring now to FIGS. 2A and 2B, diagrams illustrating two example configurations of relatively large AESA apertures 200 and 202 are shown. The AESA aperture 200 of FIG. 2A includes a single-tile (or single-PCB) antenna array 204. The antenna array 204 includes a plurality of antenna elements arranged according to a rectangular shape and forming a relatively large (e.g., larger than typical single PCB antenna arrays) single-tile AESA system. The antenna array 204 is surrounded by a passive area 206. The passive area 206 can be free of antenna elements or can include deactivated (or inactive) antenna elements.

The AESA aperture 202 of FIG. 2B depicts an example of a three-tile antenna array configuration. The AESA aperture 202 includes three antenna sub-arrays 208 separated by vertical elongated passive areas 210 across the width (or height) of the AESA aperture 202. Each sub-array 208 includes a respective plurality of antenna elements.

Figure 2C:
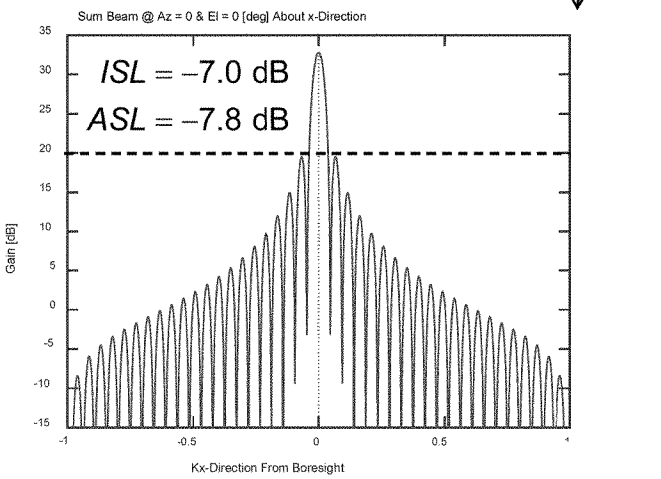
FIGS. 2C and 2D show plots illustrating simulations of antenna beams for embodiments of AESA apertures shown in FIGS. 2A and 2B, respectively.
Figure 2D:
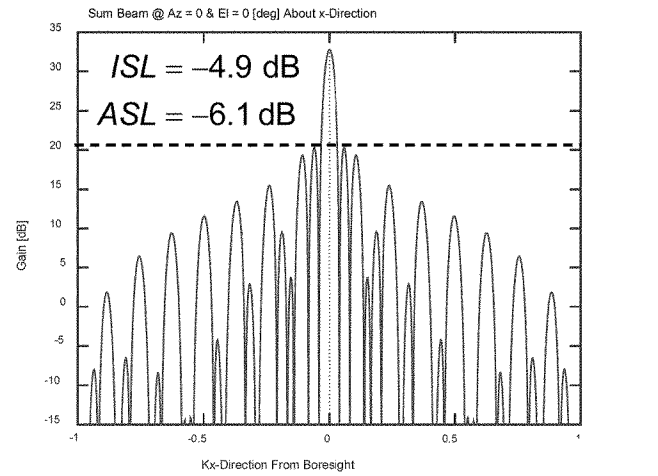

Referring now to FIGS. 2C and 2D, examples of plots illustrating simulations of antenna beams 212 and 214 for embodiments of AESA apertures 200 and 202 shown in FIGS. 2A and 2B, respectively, are shown. Comparing the AESA simulation beams 212 and 214, one can see that the main lobes in both beams are very similar in terms of the respective width and the respective maximum gain. With respect the sidelobes in both simulation beams, the AESA simulation beam 212 associated with the AESA aperture 200 includes a larger number of sidelobes than those in the simulation beam 214 associated with the AESA aperture 202. However, many of the sidelobes in the AESA beam 214 are wider and have higher maximum gain compared to sidelobes at similar Kx coordinate values in the AESA simulation beam 212 associated with the AESA aperture 200. Further, the AESA simulation beam 214 has higher gain sidelobes in the vicinity of its main lobe than the AESA simulation beam 212. The sidelobes that are closer to the main lobe contribute more to signal interference than sidelobes that are farther from the main lobe. While manufacturing the single-tile aperture 200 may not be practical, the three-tile AESA aperture 202, as an alternative, may not offer meaningful improvement in terms of antenna array performance compared to the large single-tile aperture 200. In fact, according to the simulation results shown in FIGS. 2C and 2D, the AESA aperture 200 has a better performance than the AESA aperture 202 with respect to integrated sidelobe level (ISL) and average sidelobe level (ASL).

Referring now to FIGS. 3A-3D, diagrams illustrating example embodiments of two multi-tile AESA antenna aperture configurations 300 and 302 are shown. The AESA antenna aperture 300 in FIG. 3A represents a six-tile antenna aperture configuration, while the AESA antenna aperture 302 in FIG. 3B represents a three-tile antenna aperture configuration similar to the AESA aperture 202 in FIG. 2B. The AESA antenna aperture 300 includes six antenna sub-arrays 304 separated by vertical elongated passive areas 306. The AESA antenna aperture 302 includes three antenna sub-arrays 308 separated by vertical elongated passive areas 310. Each of the vertical elongated passive areas 306 and 310 are contiguous across the height (or width) of the AESA apertures 300 and 302, respectively.

Referring now to FIGS. 3C and 3D, examples of plots representing AESA simulation beams 312 and 314 for the AESA antenna apertures shown in FIGS. 3A and 3B, respectively, are shown. The AESA simulation beam 312 in FIG. 3C represents the simulated antenna beam for the AESA aperture 300, whereas the AESA simulation beam 314 represents the simulated antenna beam for the AESA aperture 302. According to the simulation results shown in FIGS. 3C and 3D, the main beam of the AESA simulation beam 312 is very similar, in width and level, to the main beam of the AESA simulation beam 314. Also, the ASL and the ISL of the AESA simulation beam 314 are smaller than the ASL and ISL of the AESA simulation beam 312, respectively. However, the sidelobes in the vicinity of the mainlobe of the AESA simulation beam 312 have a lower level than sidelobes in the vicinity of the mainlobe of the AESA simulation beam 314. In particular, by comparing the distribution, shapes and levels of the sidelobes in the AESA simulation beam 312 to those in the AESA simulation beams 312, one can see that increasing the number of sub-arrays (e.g., from three sub-arrays in AESA aperture 312 to six sub-arrays in AESA aperture 312) can lead to a reduction in the levels of some sidelobes (e.g., sidelobes in the vicinity of the main lobe) and an increase in the levels of other sidelobes (e.g., the sidelobe in the vicinity of Kx=0.4).

Given the non-practicability of manufacturing large single-PCB AESA antenna systems, the need for AESA antenna systems with relatively large number of antenna elements (e.g., compared to existing AESA systems) calls for multi-tile (or multi-PCB) configurations of AESA systems. However, multi-tile configurations involve the use of passive areas (such as passive areas 212, 306 and 310) for use in mechanically sealing against adjacent PCBs, and such areas can result in increased sidelobe levels in respective antenna beams. In designing multi-tile AESA antenna systems, one of the goals is to improve the antenna array performance in terms of the sidelobe levels, especially in the vicinity of the main lobe. To achieve such a goal, multi-tile configurations can be employed in accordance with the inventive concepts described in this disclosure.

According to inventive concepts disclosed herein, an AESA antenna aperture can include a plurality of sub-array regions (e.g., a two-dimensional tiling of sub-arrays) having a common shape and separated by passive areas that are contiguous along at most one straight direction across the AESA antenna aperture. Each of the plurality of sub-array regions can include a plurality of antenna elements. According to example embodiments of this disclosure, the non-contiguousness of the passive areas along any straight direction across the AESA antenna aperture, or the contiguousness along at most a single straight direction across the AESA antenna aperture, can improve the antenna array performance with respect to sidelobe levels in multi-tile AESA antenna apertures. The periodicity of contiguous elongated passive areas can contribute to increasing sidelobe levels in multi-tile antenna arrays.

Figure 4:
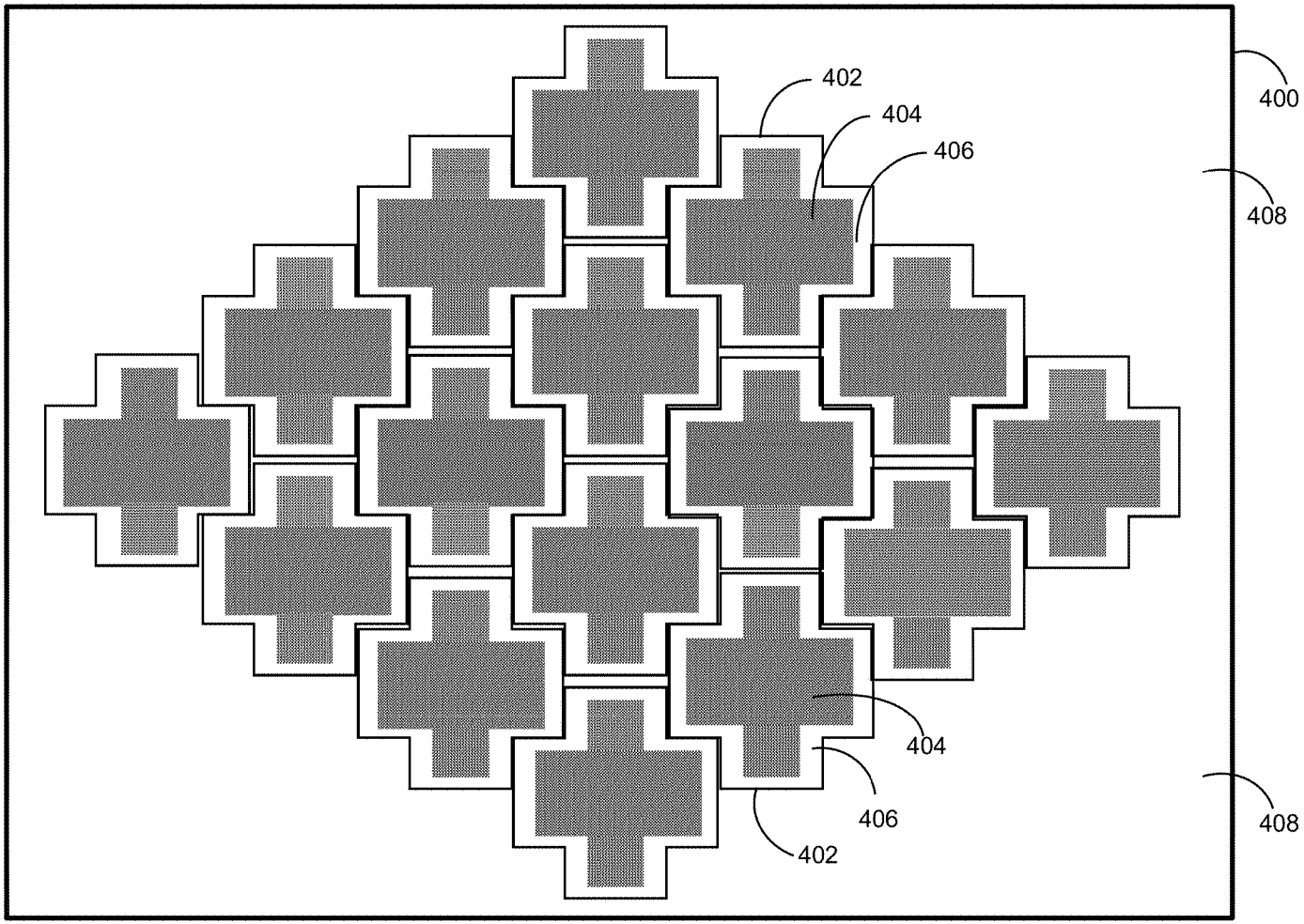
FIG. 4 is a diagram illustrating an example embodiment of a multi-tile AESA antenna aperture configuration, based on plus-shaped sub-arrays, according to inventive concepts of this disclosure.

Referring now to FIG. 4, a diagram illustrating one embodiment of a multi-tile AESA antenna aperture 400 according to inventive concepts of this disclosure is shown. The AESA antenna aperture 400 includes a plurality of plus-shaped sub-array units 402 arranged according to a two dimensional tiling configuration. Each sub-array unit 402 includes a respective sub-array of antenna elements (or a sub-array region) 404 arranged according to a plus shape. The sub-array of antenna elements 404 in each sub-array unit 402 is surrounded by a respective passive area 406. The passive areas 406 can be free of antenna elements or can include inactive (or deactivated) antenna elements. Inactive or deactivated antenna elements neither transmit nor receive radio signals. The passive areas 406 form passive separation areas between sub-arrays of antenna elements 404 in adjacent sub-array units 402.

In some embodiments, each sub-array unit 402 can correspond to a respective plus-shaped PCB hosting the sub-array of antenna elements 404 and including the respective passive area 406. Each PCB can include electrical (or electronic) circuitry for steering the respective antenna elements 404. The electrical circuitry can be printed on the back of the PCB (e.g., at the other side of the PCB with respect to where the sub-array of antenna elements 404 is located). The electrical circuitry can include for each antenna element a respective transmitter/receiver module (TRM). For each antenna element, the respective TRM can include a phase shifter (or time delay element) and a gain amplifier. The electrical circuitry can also include electric current (or voltage) accumulators and/or electric current (or voltage) splitters. In some embodiments, the electrical circuitry can include a receiving (RX) circuit and/or a transmitting (TX) circuit. In some embodiments, each sub-array unit 402 can be configured to switch between a RX operation mode and a TX operation mode. In some embodiments, some sub-array units 402 can be designated as receivers while others can be designated as transmitters. Electrical circuitries for various sub-array units 402 can be electrically coupled together, for example, via electric current (or voltage) accumulators and/or electric current (or voltage) splitters.

In the sub-array tiling configuration shown in FIG. 4, the passive areas 406 are implemented or designed such that they are not contiguous along any straight direction across the AESA antenna aperture 400. For instance, any straight line would not cross the AESA antenna aperture 400 along a continuous extended assembly/chain of passive areas 406 without crossing any active areas hosting active antenna elements 404. Designing the AESA antenna aperture 400 in a way to avoid elongated passive areas that are parallel or spatially-periodic across the AESA antenna aperture in two or more directions allows for reduced levels of antenna beam sidelobes compared to apertures with contiguous passive areas that are parallel to each other along two or more directions. In some embodiments, a region 408 can be a passive area. In such embodiments, the tiling of the antenna sub-array units 402 can form a diamond-like (or parallelogram-like) shape. In some other embodiments, the region 408 can include additional antenna sub-array units 402 (other than the ones shown in FIG. 4). For instance, additional sub-array units can be used such that the tiling has a rectangular shape, square shape, or other shape. At the boundaries of a rectangular (or square) shaped antenna array, sub-array units of a different shape and size than the plus-shaped sub-array units 402 can be employed.

The AESA antenna aperture 400 can include a mechanical seal to mechanically connect the antenna sub-array units 402 into a multi-tile AESA antenna aperture 402. The mechanical seal can include a mechanical chassis (such as mechanical chassis 102 shown in FIG. 1) arranged around a periphery of the AESA antenna aperture 400. For instance, the mechanical chassis can be arranged around the region 408. The mechanical seal can also include mechanical connectors (such as screws, metallic or plastic wires, adhesives, tape, or the like) arranged at or using the passive areas 406, to mechanically connect adjacent antenna sub-arrays (or adjacent PCBs) to each other.

Figure 5:
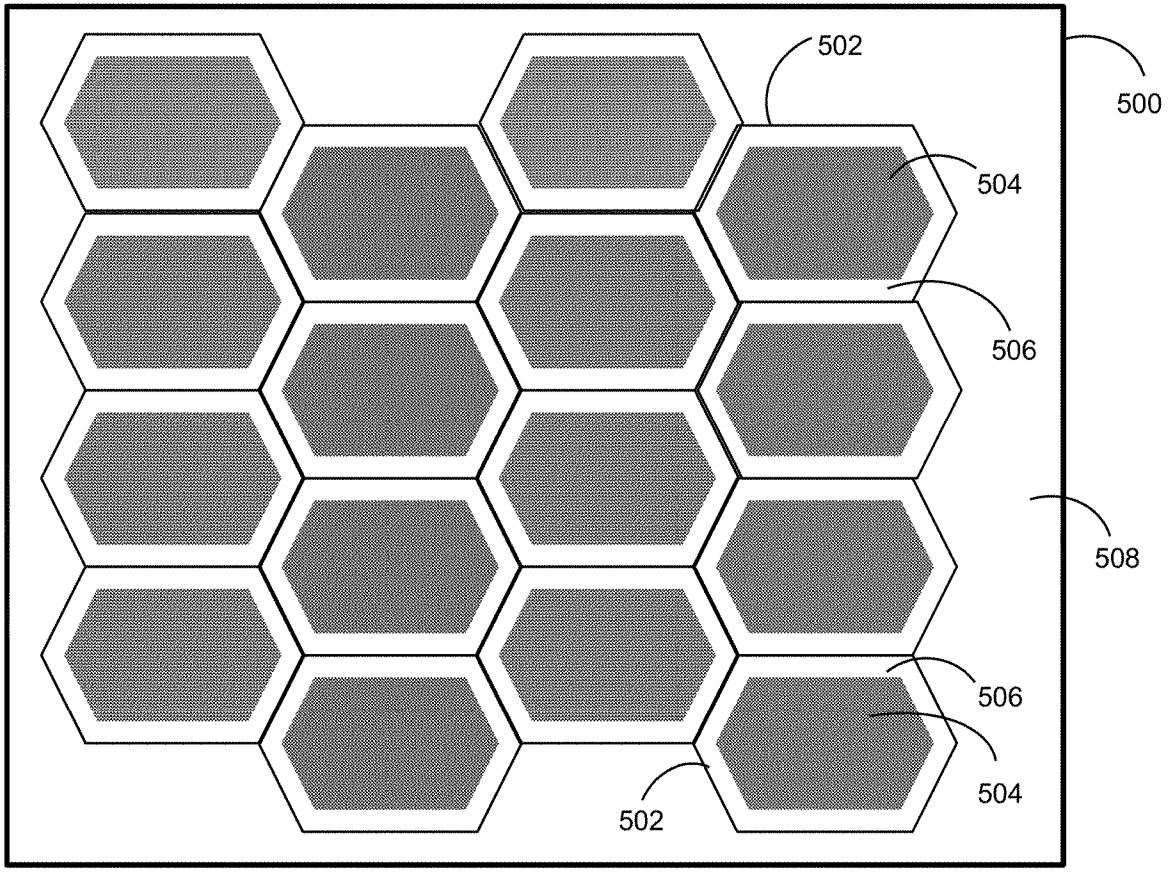
FIG. 5 is a diagram illustrating another example embodiment of a multi-tile AESA antenna aperture configuration, based on hexagon-shaped sub-array units, according to inventive concepts of this disclosure.

Referring now to FIG. 5, a diagram illustrating an example embodiment of a multi-tile AESA antenna aperture 500 based on hexagon-shaped sub-array units 502, according to inventive concepts of this disclosure is shown. The AESA antenna aperture 500 includes a plurality (e.g., a two-dimensional tiling) of hexagon-shaped sub-array units 502 arranged according to a bee-hive structure. Each sub-array unit 502 includes a hexagon shaped sub-array of antenna elements 504 surrounded by a respective passive area 506. The passive areas 506 can be free of antenna elements or can include deactivated (or inactive) antenna elements. Similar to the passive areas 406 of the AESA antenna aperture 400, the passive areas 506 are not contiguous along any straight direction across the of the AESA antenna aperture 500.

Similar to the AESA antenna aperture 400, each sub-array unit 502 can correspond to a respective hexagon-shaped PCB hosting the sub-array of antenna elements 504 and including the respective passive area 506. Each PCB can include electrical (or electronic) circuitry for steering the respective sub-array of antenna elements 504. The electrical circuitry can be printed on the back of the PCB (e.g., at the other side of the PCB with respect to where the sub-array of antenna elements 504 is located). The electrical circuitry can include for each antenna element a respective transmitter/receiver module (TRM). For each antenna element, the respective TRM can include a phase shifter (or time delay element) and a gain amplifier. The electrical circuitry can also include electric current (or voltage) accumulators and/or electric current (or voltage)splitters. In some embodiments, the electrical circuitry can include a receiving (RX) circuit and/or a transmitting (TX) circuit. In some embodiments, each sub-array unit 502 can be configured to switch between a RX operation mode and a TX operation mode. In some embodiments, some sub-array units 502 can be designated as receivers while others can be designated as transmitters. Electrical circuitries for various sub-array units 502 can be electrically coupled together, for example, via electric current (or voltage) accumulators and/or electric current (or voltage) splitters. The AESA antenna aperture 500 can include a mechanical seal or structure to connect the antenna sub-array units 502 into a multi-tile AESA antenna aperture, as discussed above with regard to AESA antenna aperture 400.

Figure 6:
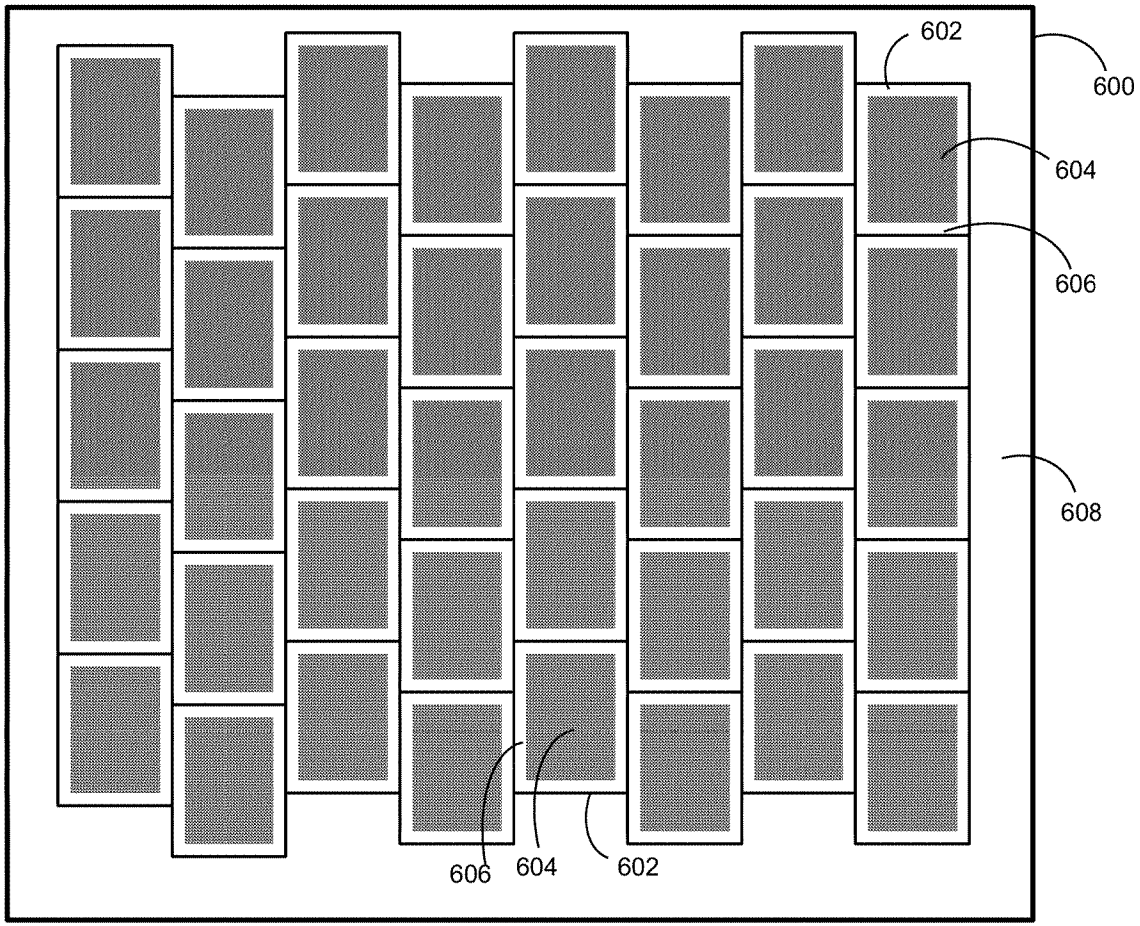
FIG. 6 is a diagram illustrating another example embodiment of a multi-tile AESA antenna aperture configuration, based on rectangular-shaped sub-array units, according to inventive concepts of this disclosure.

Referring now to FIG. 6, a diagram illustrating an example embodiment of a multi-tile AESA antenna aperture 600 based on rectangular-shaped sub-array units 602, according to inventive concepts of this disclosure is shown. The AESA antenna aperture 600 includes a plurality (e.g., a two-dimensional tiling) of rectangular-shaped sub-array units 602. Adjacent columns of the rectangular-shaped sub-array units are vertically shifted with respect to one-another to prevent horizontal alignment of adjacent sub-array units 602. Each sub-array unit 602 includes a rectangular shaped sub-array of antenna elements 604 surrounded by a respective passive area 606. The passive areas 606 can be free of antenna elements or can include deactivated (or inactive) antenna elements. Due to the arrangement (e.g., the vertical shift among adjacent columns) of sub-array units 602, the passive areas 604 may only be contiguous along the vertical direction across the of the AESA antenna aperture 600. In some embodiments, the sub-array units 602 can include horizontally elongated rectangles arranged such that adjacent rows of the rectangular-shaped sub-array units are horizontally shifted with respect to one-another to prevent vertical alignment of adjacent sub-array units 602. In such embodiments, the passive areas 604 may only be contiguous along the horizontal direction across the of the AESA antenna aperture 600. In some embodiments, the sub-array units 602 can have square shapes where adjacent columns are vertically shifted with respect to one another or horizontal rows are vertically shifted with respect to one another.

Each sub-array unit 602 can correspond to a respective rectangular-shaped PCB hosting the sub-array of antenna elements 604 and including the respective passive area 606. Each PCB can include electrical (or electronic) circuitry for steering the respective sub-array of antenna elements 604. The electrical circuitry can be printed on the back of the PCB (e.g., at the other side of the PCB with respect to where the sub-array of antenna elements 604 is located). The electrical circuitry can include for each antenna element a respective transmitter/receiver module (TRM). For each antenna element, the respective TRM can include a phase shifter (or time delay element) and a gain amplifier. The electrical circuitry can also include electric current (or voltage) accumulators and/or electric current (or voltage) splitters. In some embodiments, the electrical circuitry can include a receiving (RX) circuit and/or a transmitting (TX) circuit. In some embodiments, each sub-array unit 600 can be configured to switch between a RX operation mode and a TX operation mode. In some embodiments, some sub-array units 600 can be designated as receivers while others can be designated as transmitters. Electrical circuitries for various sub-array units 600 can be electrically coupled together, for example, via electric current (or voltage) accumulators and/or electric current (or voltage) splitters. The AESA antenna aperture 600 can include a mechanical seal or structure to connect the antenna sub-array units 602 into a multi-tile AESA antenna aperture, as discussed above with regard to AESA aperture 400.

Figure 7:
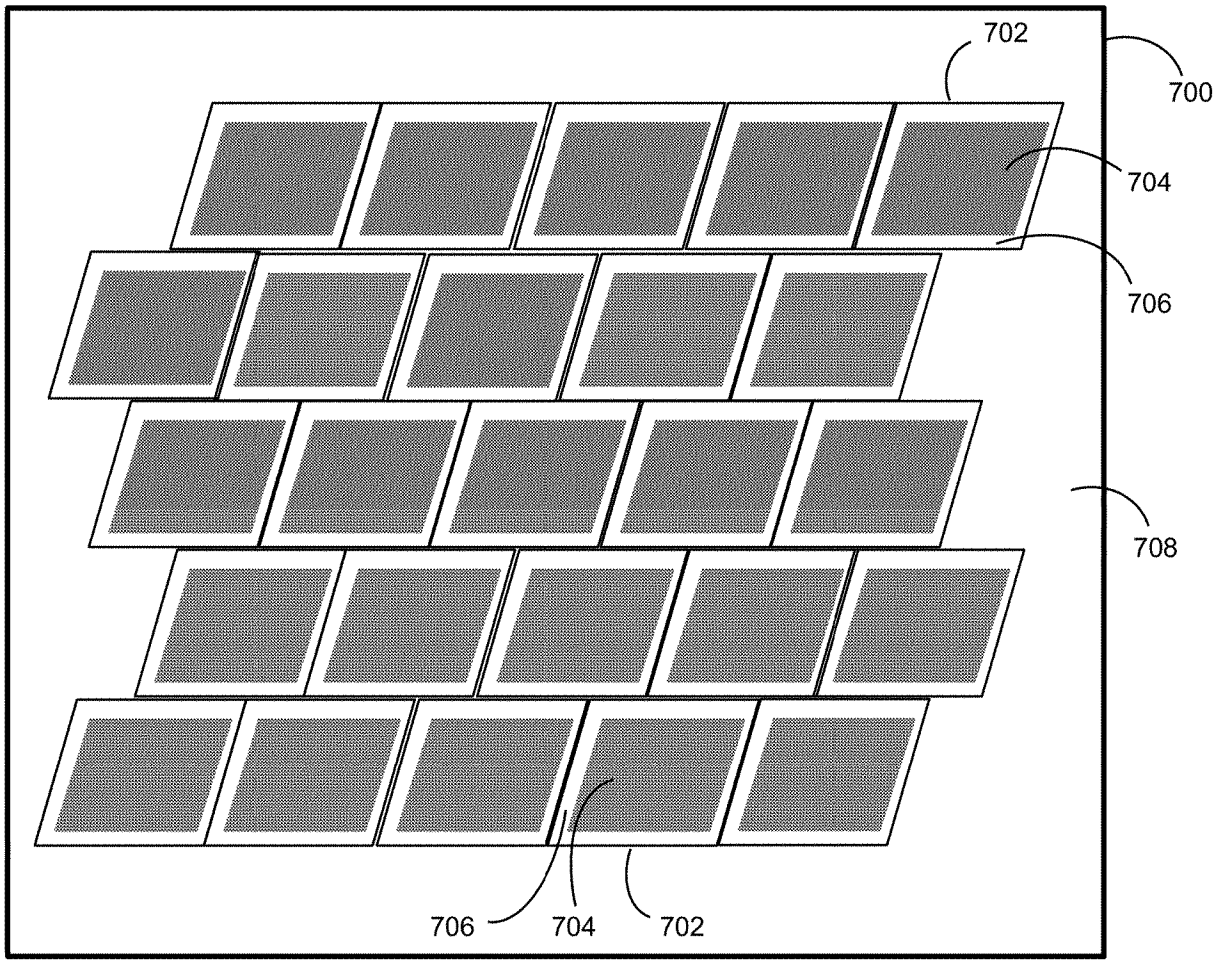
FIG. 7 is a diagram illustrating another example embodiment of a multi-tile AESA antenna aperture configuration, based on parallelogram-shaped sub-array units, according to inventive concepts of this disclosure.

Referring now to FIG. 7, a diagram illustrating another example embodiment of a multi-tile AESA antenna aperture 700, which is based on parallelogram-shaped sub-array units 702, according to inventive concepts of this disclosure. The AESA antenna aperture 700 includes a plurality (e.g., a two-dimensional tiling) of parallelogram-shaped sub-array units 702. Adjacent rows of the rectangular-shaped sub-array units are horizontally shifted with respect to one-another to prevent vertical alignment of adjacent sub-array units 702. Each sub-array unit 702 includes a parallelogram-shaped sub-array of antenna elements 704 surrounded by a respective passive area 706. The passive areas 706 can be free of antenna elements or can include deactivated (or inactive) antenna elements. Due to the arrangement (e.g., the horizontal shift among adjacent rows) of sub-array units 702, the passive areas 706 are only contiguous along the horizontal direction across the AESA antenna aperture 700. In some embodiments, the sub-array units 702 can be arranged such that adjacent columns of the parallelogram-shaped sub-array units 702 are vertically shifted with respect to one-another to prevent horizontal alignment of adjacent sub-array units 702. In such embodiments, the passive areas 706 are only contiguous along the vertical direction across the of the AESA antenna aperture 700. In some embodiments, the sub-array units 702 can have diamond (or rhombus) type shapes.

Each sub-array unit 702 can correspond to a respective parallelogram (or diamond) shaped PCB hosting the sub-array of antenna elements 704 and including the respective passive area 706. Each PCB can include electrical (or electronic) circuitry for steering the respective sub-array of antenna elements 704. The electrical circuitry can be printed on the back of the PCB (e.g., at the other side of the PCB with respect to where the sub-array of antenna elements 704 is located). The electrical circuitry can include for each antenna element a respective transmitter/receiver module (TRM). For each antenna element, the respective TRM can include a phase shifter (or time delay element) and a gain amplifier. The electrical circuitry can also include electric current (or voltage) accumulators and/or electric current (or voltage)splitters. In some embodiments, the electrical circuitry can include a receiving (RX) circuit and/or a transmitting (TX) circuit. In some embodiments, each sub-array unit 702 can be configured to switch between a RX operation mode and a TX operation mode. In some embodiments, some sub-array units 702 can be designated as receivers while others can be designated as transmitters. Electrical circuitries for various sub-array units 702 can be electrically coupled together, for example, via electric current (or voltage) accumulators and/or electric current (or voltage) splitters. The AESA antenna aperture 700 can include a mechanical seal or structure to connect the antenna sub-array units 702 into a multi-tile AESA antenna aperture, as discussed above with regard to AESA aperture 400.

According to inventive concepts of this disclosure, an AESA antenna system can include a plurality of PCBs having a common shape. Each PCB of the plurality of PCBs can correspond to a sub-array unit (such as sub-array units 410, 510, 610 or 710) and can host a respective sub-array of antenna elements (such as sub-arrays 414, 514, 614 or 714) and a passive area (such as passive areas 412, 512, 612 or 712) surrounding the sub-array of antenna elements. Each PCB can also include electronic circuitry for electrically steering the respective sub-array of antenna elements. The AESA antenna system can also include a mechanical seal for mechanically connecting the PCBs hosting the sub-arrays to form an antenna array of the sub-arrays. The passive areas can form separation areas between adjacent sub-arrays when the PCBs are mechanically connected to each other. The sub-arrays can be arranged such that the separation areas are contiguous along at most one straight direction across the antenna array. For instance, the separation areas can be contiguous along a single straight direction such as discussed above with regard to FIGS. 6 and 7. In some other instances, the separation areas can be non-contiguous along each straight direction such as discussed above with regard to FIGS. 4 and 5.

The mechanical seal can include a mechanical chassis (such as mechanical chassis 15 shown in FIG. 1) arranged around a periphery of the PCBs and/or passive areas of the AESA antenna system (as discussed above with regard to FIGS. 4-7). The mechanical seal can also include mechanical connectors (such as screws, metallic or plastic wires, adhesives, tape, or the like) arranged at the passive areas to mechanically connect adjacent antenna sub-arrays (or adjacent PCBs) to each other.

The AESA antenna system can also include at least one processor coupled to the sub-arrays of antenna elements via the respective electronic circuitries. The electronic circuitries associated with the plurality of PCBs can be coupled to each other and to the at least one processor via electric current (or voltage) accumulators or electric current (or voltage) splitters. Each electronic circuitry can include TRMs for the respective plurality of antenna elements. The at least one processor can be configured to steer the antenna elements associated with the plurality of PCBs.

While the AESA antenna apertures discussed herein (e.g., with regard to FIGS. 4-7) are described as 2-dimensional tiling configurations, the same tiling patterns can be implemented according to curved or 3-dimensional surface. Adjacent PCBs (or sub-array units) can be mechanically connected to one another at an angle such that the corresponding multi-tile aperture can have a contoured surface.

Figure 8A:
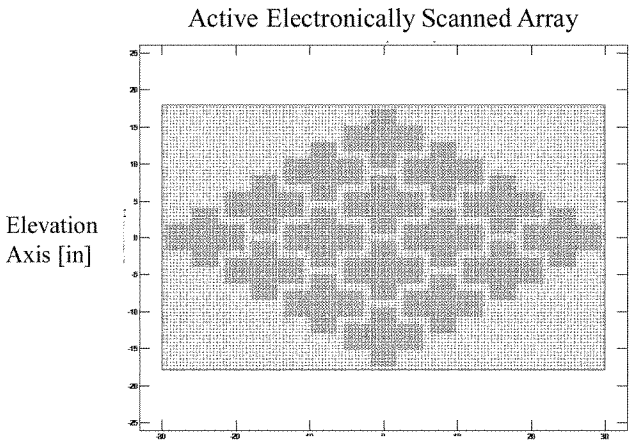
FIGS. 8A-8D show diagrams illustrating an example embodiment of a multi-tile AESA antenna aperture configuration based on plus-shaped sub-array units, and corresponding antenna beam simulation results.

Referring now to FIGS. 8A-8D, diagrams illustrating one embodiment of a multi-tile AESA antenna aperture configuration based on plus-shaped sub-array units and corresponding antenna beam simulation results are shown. FIG. 8A is a diagram depicting an example embodiment of AESA antenna aperture that includes a plurality of plus-shaped sub-array units (similar to the AESA antenna aperture 400 in FIG. 4). The plurality of plus-shaped sub-array units are tiled to form a diamond like shaped array of antenna elements surrounded by a passive area. Also, adjacent sub-arrays of antenna elements are separated by passive areas that are not contiguous along any direction. The AESA antenna aperture has an azimuth length equal to 60.03 inches and an elevation length equal to 35.84 inches, by way of example. The AESA antenna aperture includes a total of 10,720 antenna elements, with maximum number of 134 antenna elements along the azimuth direction and a maximum number of 80 antenna elements along the elevation direction, for instance.

Figure 8B:
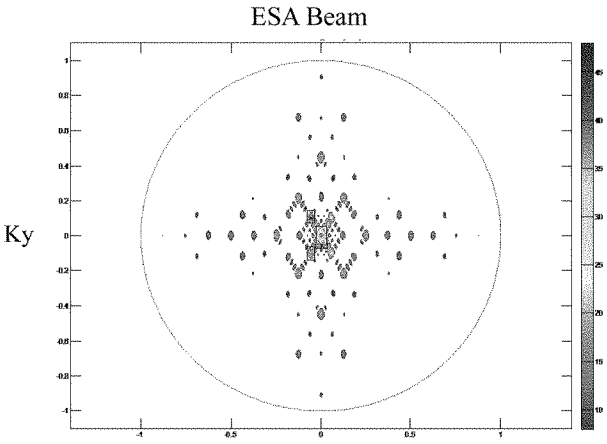
Figure 8C:
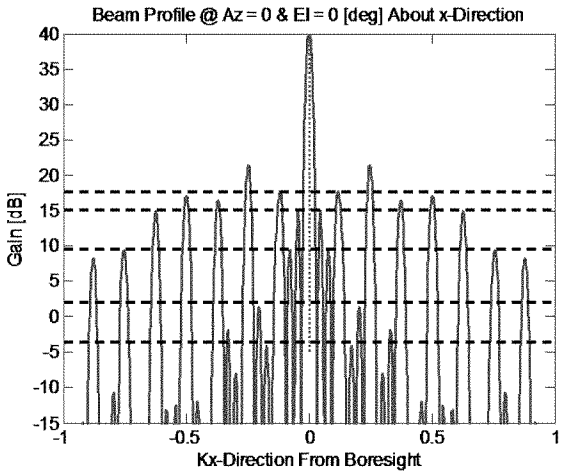
Figure 8D:
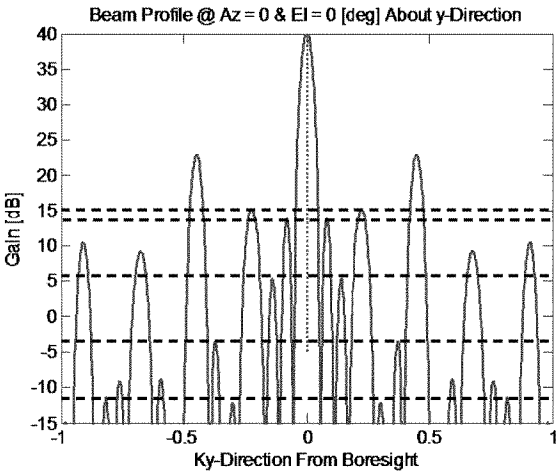

The antenna array gain for the AESA antenna aperture of FIG. 8A is simulated with a center frequency equal to 11.70 GHz. FIG. 8B shows the AESA beam of the AESA antenna aperture of FIG. 8A. FIGS. 8C and 8D show example embodiments of AESA beam profiles along the Kx and Ky directions, respectively, at azimuth equal to 0 and elevation equal to 0. According to simulation results for the AESA antenna aperture of FIG. 8A, the measured azimuth beam width is equal to 1.01 degree and the measured elevation beam width is equal to 2.02 degrees. The measured peak gain is equal to 40.33 dB and the measured peak sidelobe is equal to 25.16 dB. Also, the sum beam gain is equal to 40.33 dB, the sum beam maximum sidelobe is equal to 25.16 dB, the sum beam root mean square ISL is equal to −3.74 dB, and the sum beam root mean square ASL is equal to −5.26 dB.

Figure 9A:
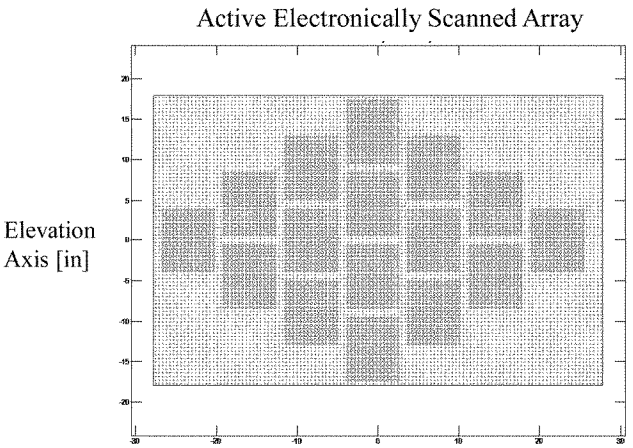
FIGS. 9A-9D show diagrams illustrating an example embodiment of a multi-tile AESA antenna aperture configuration based on rectangular-shaped sub-array units, and corresponding antenna beam simulation results.

Referring now to FIGS. 9A-9D, diagrams illustrating an example embodiment of a multi-tile AESA antenna aperture configuration based on rectangular-shaped sub-array units and corresponding antenna beam simulation results are shown. FIG. 9A is a diagram depicting an AESA antenna aperture includes a plurality of rectangular-shaped sub-array units, similar to the AESA antenna aperture 600 in FIG. 6 but with different shape of the multi-tile antenna array. The plurality of rectangular-shaped sub-array units are tiled to form a diamond like shaped array of antenna elements surrounded by a passive area. Also, adjacent sub-arrays of antenna elements are separated by passive areas that are only contiguous along the vertical direction. The AESA antenna aperture has an azimuth length equal to 55.55 inches and an elevation length equal to 35.84 inches. The AESA antenna aperture includes a total of 9,920 antenna elements, with maximum number of 124 antenna elements along the azimuth direction and a maximum number of 80 antenna elements along the elevation direction.

Figure 9B:
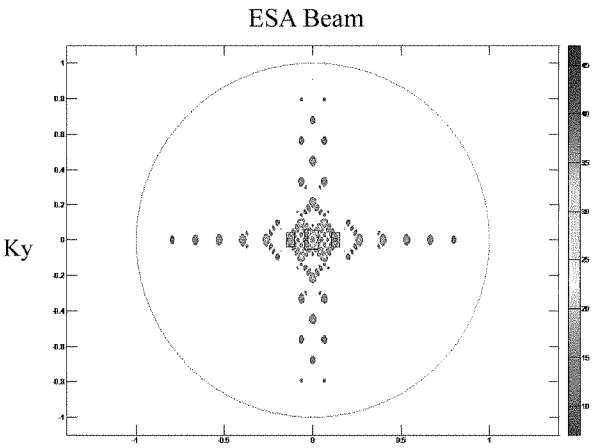
Figure 9C:
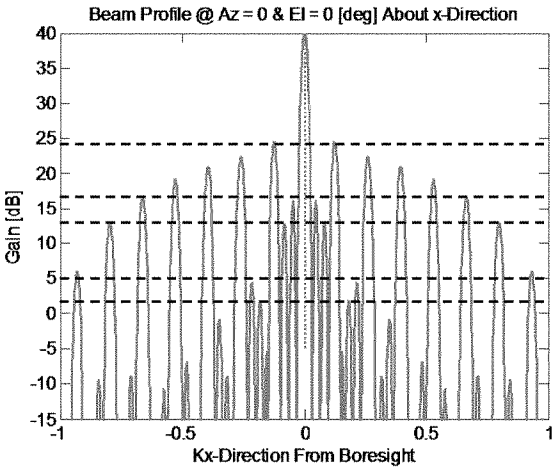
Figure 9D:
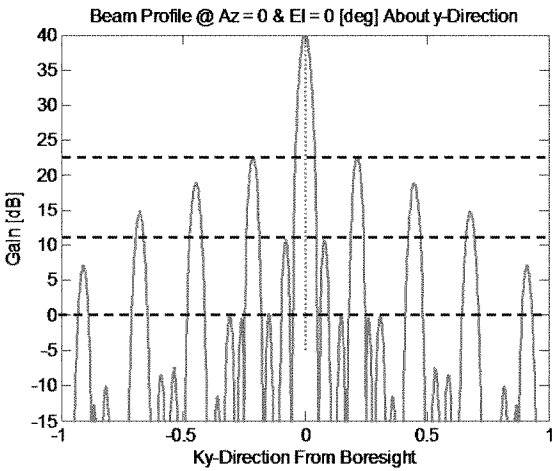

The antenna array gain for the AESA antenna aperture of FIG. 9A, for example, is simulated with a center frequency equal to 11.70 GHz. FIG. 9B shows the AESA beam of the AESA antenna aperture of FIG. 9A. FIGS. 9C and 9D show the AESA beam profiles along the Kx and Ky directions, respectively, at azimuth equal to 0 and elevation equal to 0. According to simulation results for the AESA antenna aperture of FIG. 9A, the measured azimuth beam width is equal to 1.01 degree and the measured elevation beam width is equal to 2.02 degrees. The measured peak gain is equal to 40.30 dB and the measured peak sidelobe is equal to 25.61 dB. Also, the sum beam gain is equal to 40.30 dB, the sum beam maximum sidelobe is equal to 25.61 dB, the sum beam root mean square ISL is equal to −4.06 dB, and the sum beam root mean square ASL is equal to −5.49 dB.

Comparing the simulation results for the AESA antenna apertures of FIGS. 8A and 9A to those for the antenna apertures in FIGS. 2A, 2B, 3A, and 3B, one can deduce that the antenna apertures of FIGS. 8A and 9A provide better performance with respect to the reduction of sidelobe levels in the vicinity of the main lobe. For instance, the main lobe level is about 33 dB and the closest sidelobe (closest to the main lobe) level is about 20 dB in the simulation results shown FIG. 2C. As such, the ratio of main lobe level to the closest sidelobe level is about 1.65. The ratio is about 1.61 for the simulation results in FIGS. 3C and 3D. However, the ratio is equal to 2.66 based on the simulation results in FIG. 8C, and is equal to about 2.42 based on the simulation results shown in FIG. 9C. Such results indicate that the antenna apertures of FIGS. 8A and 8B perform significantly better than the antenna apertures shown in FIGS. 2A, 2B, 3A, and 3B with respect to reducing sidelobe levels in the neighborhood of the main lobe.

Comparing the simulation results for the AESA antenna aperture of FIG. 8A to those for the AESA antenna aperture of FIG. 9A, one can see that the main lobes for both apertures are very similar. However, the AESA antenna aperture of FIG. 9A performs slightly better with regard to both the ISL and the ASL compared to the AESA antenna aperture of FIG. 8A. Yet, considering the levels of the five closest sidelobes to the respective main lobe in FIGS. 8C, 8D (see the horizontal dashed lines in those figures), one can deduce that the antenna aperture configuration performs better at reducing the sidelobe levels at the neighborhood of the respective main lobe, especially along the Kx axis.

Figure 10:
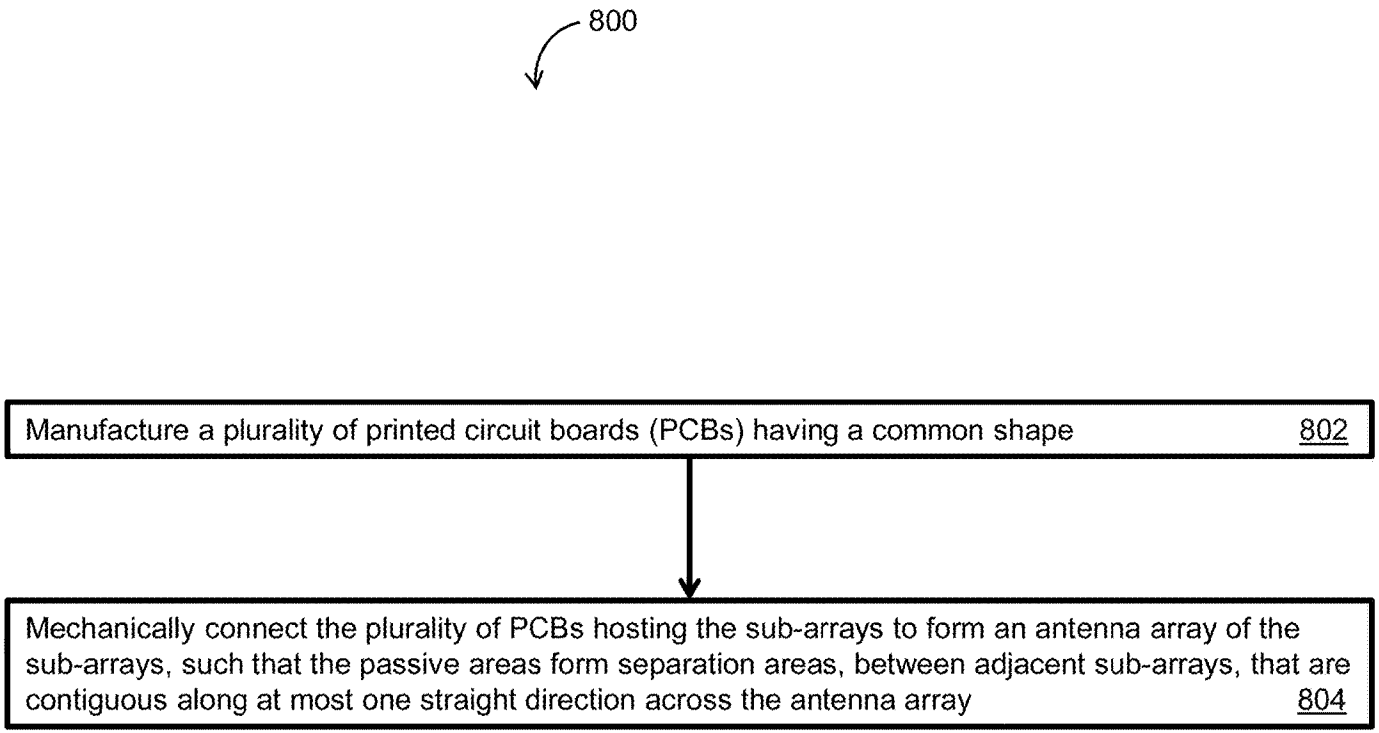
FIG. 10 shows a flowchart illustrating an example embodiment of a method of providing (or manufacturing) an AESA antenna system, according to inventive concepts of this disclosure.

Referring now to FIG. 10, a flowchart illustrating one embodiment of a method 800 of providing (or manufacturing) an AESA antenna system, according to inventive concepts disclosed herein is shown. The method 800 includes manufacturing a plurality of printed circuit boards (PCBs) having a common shape (step 802). Each PCB of the plurality of PCBs includes a respective sub-array of antenna elements surrounded by a passive area. Each PCB includes electronic circuitry for electrically steering the sub-array of antenna elements. The method further includes mechanically connecting the plurality of PCBs hosting the sub-arrays to form an antenna array of the sub-arrays (step 804). The passive areas can form separation areas between adjacent sub-arrays. The separation areas are contiguous along at most one straight direction across the antenna array. For instance, any straight line would not cross the antenna array along a continuous extended assembly/chain of passive areas without crossing any active areas hosting active antenna elements.

The method includes manufacturing a plurality of printed circuit boards (PCBs) having a common shape (step 802). The PCBs can have a plus shape (as discussed above with regard to FIGS. 4 and 8A), a rectangular shape (as discussed above with regard to FIGS. 6 and 9A), a square shape (as discussed above with regard to FIG. 6), a hexagon shape (as discussed above with regard to FIG. 5), or a parallelogram or diamond shape (as discussed above with regard to FIG. 7). For each PCB, the respective electronic circuitry and the respective sub-array of antenna elements can be located at different surfaces (or sides) of that PCB. For each PCB, the respective passive area(s) can be free of antenna elements or can include inactive (or disabled) antenna elements.

The electronic (or electrical) circuitry can include for each antenna element a respective transmitter/receiver module (TRM). For each antenna element, the respective TRM can include a phase shifter (or time delay element) and a gain amplifier. The electrical circuitry can also include electric current (or voltage) accumulators and/or electric current (or voltage) splitters. In some embodiments, the electrical circuitry can include a receiving (RX) circuit and/or a transmitting (TX) circuit. In some embodiments, each PCB can be configured to switch between a RX operation mode and a TX operation mode. In some embodiments, some PCBs can be designated as receivers while others can be designated as transmitters.

The method can include mechanically connecting the plurality of PCBs hosting the sub-arrays to form an antenna array of the sub-arrays, such that the passive areas form separation areas, between adjacent sub-arrays, that are contiguous along at most one straight direction across the antenna array (step 804). Mechanically connecting the PCBs can include tiling the plurality of PCBS into an antenna aperture. Mechanically connecting the PCBs can include using a mechanical chassis (such as mechanical chassis 102 shown in FIG. 1) around the periphery of the antenna aperture or around passive areas surrounding the antenna aperture. Mechanically connecting the PCBs can also include using mechanical connectors (such as screws, metal or plastic cables, tape, adhesives, or the like) to connect adjacent PCB (within the antenna aperture) to one another. The mechanical connectors can be employed (or integrated) at the passive areas separating adjacent sub-arrays. The tiling of the PCBs can arranged or configured in a way that the separation areas are non-contiguous along any straight direction across the antenna array (or along the antenna aperture).

In some embodiments, the method 800 can further include electrically coupling the electrical circuitries for various PCBs to each other and/or to other electrical/electronic components, such as a processor. For instance, the electrical circuitries for various PCBs can be electrically coupled together and/or to other electric components, for example, via electric current (or voltage) accumulators and/or electric current (or voltage) splitters.

The construction and arrangement of the systems and methods are described herein as illustrative examples and are not to be construed interpreted as limiting. Although only a few embodiments have been described in detail in this disclosure, many modifications are possible (e.g., variations in sizes, dimensions, structures, shapes and proportions of the various elements, values of parameters, mounting arrangements, use of materials, colors, orientations). For example, the position of elements may be reversed or otherwise varied and the nature or number of discrete elements or positions may be altered or varied. Accordingly, all such modifications are intended to be included within the scope of the inventive concepts disclosed herein. The order or sequence of any operational flow or method operations may be varied or re-sequenced according to alternative embodiments. Other substitutions, modifications, changes, and omissions may be made in the design, operating conditions and arrangement of the exemplary embodiments without departing from the broad scope of the inventive concepts disclosed herein.

What is claimed is:

1. An active electronically scanned array (AESA) antenna system comprising:

a plurality of printed circuit boards (PCBs) having a common shape, each PCB of the plurality of PCBs including a respective sub-array of antenna elements surrounded by a passive area and having electronic circuitry for electrically steering the sub-array of antenna elements; and a mechanical seal for mechanically connecting the PCBs including the sub-arrays to form an antenna array of the sub-arrays, wherein the passive areas form separation areas between adjacent ones of the sub-arrays when the PCBs are mechanically connected to each other, and the sub-arrays are arranged such that the separation areas are contiguous along at most one straight direction across the antenna array.

2. The AESA antenna system of claim 1, wherein the separation areas are non-contiguous along any straight direction across the antenna array.

3. The AESA antenna system of claim 1, wherein the common shape comprises a plus shape.

4. The AESA antenna system of claim 1, wherein the common shape comprises a rectangle.

5. The AESA antenna system of claim 1, wherein the common shape comprises a square.

6. The AESA antenna system of claim 1, wherein the common shape comprises a hexagon.

7. The AESA antenna system of claim 1, wherein the common shape comprises a diamond shape.

8. The AESA antenna system of claim 1, wherein the common shape comprises a parallelogram.

9. The AESA antenna system of claim 1, wherein the separation areas include one or more inactive or disabled antenna elements.

10. The AESA antenna system of claim 1, wherein the separation areas are free of antenna elements.

11. The AESA antenna system of claim 1, wherein the mechanical seal includes a mechanical chassis arranged around a periphery of the antenna array.

12. The AESA antenna system of claim 1, wherein the mechanical seal includes one or more mechanical connectors arranged at the separation areas for mechanically connecting adjacent PCBs.

13. A method of providing an active electronically scanned array (AESA) antenna system, the method comprising:

manufacturing a plurality of printed circuit boards (PCBs) having a common shape, each PCB of the plurality of PCBs including a respective sub-array of antenna elements surrounded by a passive area and having electronic circuitry for electrically steering the sub-array of antenna elements; and mechanically connecting the plurality of PCBs hosting the sub-arrays to form an antenna array of the sub-arrays, wherein the passive areas form separation areas between adjacent ones of the sub-arrays, the separation areas being contiguous along at most one straight direction across the antenna array.

14. The method of claim 13, wherein the common shape includes at least one of:

a plus shape;

a rectangle;

a square;

a hexagon;

a diamond shape; or a parallelogram.

15. The method of claim 13, wherein the passive areas include inactive or disabled antenna elements, or are free of antenna elements.

16. The method of claim 13, wherein the separation areas are non-contiguous along any straight direction across the antenna array.

* * * * *